US010983468B2

(12) United States Patent
Matsumoto et al.

(10) Patent No.: US 10,983,468 B2
(45) Date of Patent: Apr. 20, 2021

(54) PRINTING APPARATUS AND PRINTED MATTER PRINTED BY SAME

(71) Applicant: Ricoh Company, Ltd., Tokyo (JP)

(72) Inventors: Kazuyoshi Matsumoto, Tokyo (JP); Megumi Arai, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 130 days.

(21) Appl. No.: 16/185,286

(22) Filed: Nov. 9, 2018

(65) Prior Publication Data

US 2019/0212685 A1 Jul. 11, 2019

(30) Foreign Application Priority Data

Jan. 10, 2018 (JP) ..... JP2018-001749

(51) Int. Cl.
*G03G 15/00* (2006.01)
*G03G 15/23* (2006.01)

(52) U.S. Cl.
CPC ..... *G03G 15/5029* (2013.01); *G03G 15/234* (2013.01)

(58) Field of Classification Search
CPC ..... G03G 15/23; G03G 15/5029; G03G 15/6582; G03G 15/6585; G03G 2215/00789
USPC ..... 399/45, 407, 411
See application file for complete search history.

(56) References Cited

U.S. PATENT DOCUMENTS

| | | | | |
|---|---|---|---|---|
| 4,928,136 | A * | 5/1990 | Kusumoto | B82Y 15/00 399/14 |
| 2003/0007814 | A1* | 1/2003 | Richards | G03G 15/2021 399/341 |
| 2018/0072448 | A1* | 3/2018 | Hama | G06Q 10/043 |

FOREIGN PATENT DOCUMENTS

| | | |
|---|---|---|
| JP | 60-041089 | 3/1985 |
| JP | 3085035 | 12/2001 |
| JP | 2005-224280 | 8/2005 |
| JP | 2007-322819 | 12/2007 |
| JP | 2010-048892 | 3/2010 |
| JP | 2012-040850 | 3/2012 |
| JP | 2012-061015 | 3/2012 |
| JP | 2013-200583 | 10/2013 |

* cited by examiner

*Primary Examiner* — Benjamin R Schmitt
(74) *Attorney, Agent, or Firm* — Xsensus LLP

(57) ABSTRACT

A printing apparatus includes a printer and a sheet feeder. The sheet feeder feeds a sheet to the printer in a feed direction. The printer prints a folding guide line on the sheet with a transparent recording agent or a recording agent having a similar color close to the color of the sheet.

13 Claims, 9 Drawing Sheets

PRINTING APPARATUS AND PRINTED MATTER PRINTED BY SAME

CROSS-REFERENCE TO RELATED APPLICATION

This patent application is based on and claims priority pursuant to 35 U.S.C. § 119(a) to Japanese Patent Application No. 2018-001749, filed on Jan. 10, 2018, in the Japan Patent Office, the entire disclosure of which is hereby incorporated by reference herein.

BACKGROUND

Technical Field

This disclosure relates to a printing apparatus capable of printing a folding guide line and a printed matter printed by the printing apparatus.

Description of the Related Art

Among image forming apparatuses, there is an image forming apparatus, such as a printing apparatus and a recording apparatus, capable of printing a development view on a sheet-shaped recording medium, such as a paper, a sheet, and the like.

SUMMARY

According to embodiments of the present disclosure, an improved printing apparatus includes a printer and a sheet feeder. The sheet feeder feeds a sheet to the printer in a feed direction. The printer prints a folding guide line on the sheet with a transparent recording agent or a recording agent having a similar color close to the color of the sheet.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
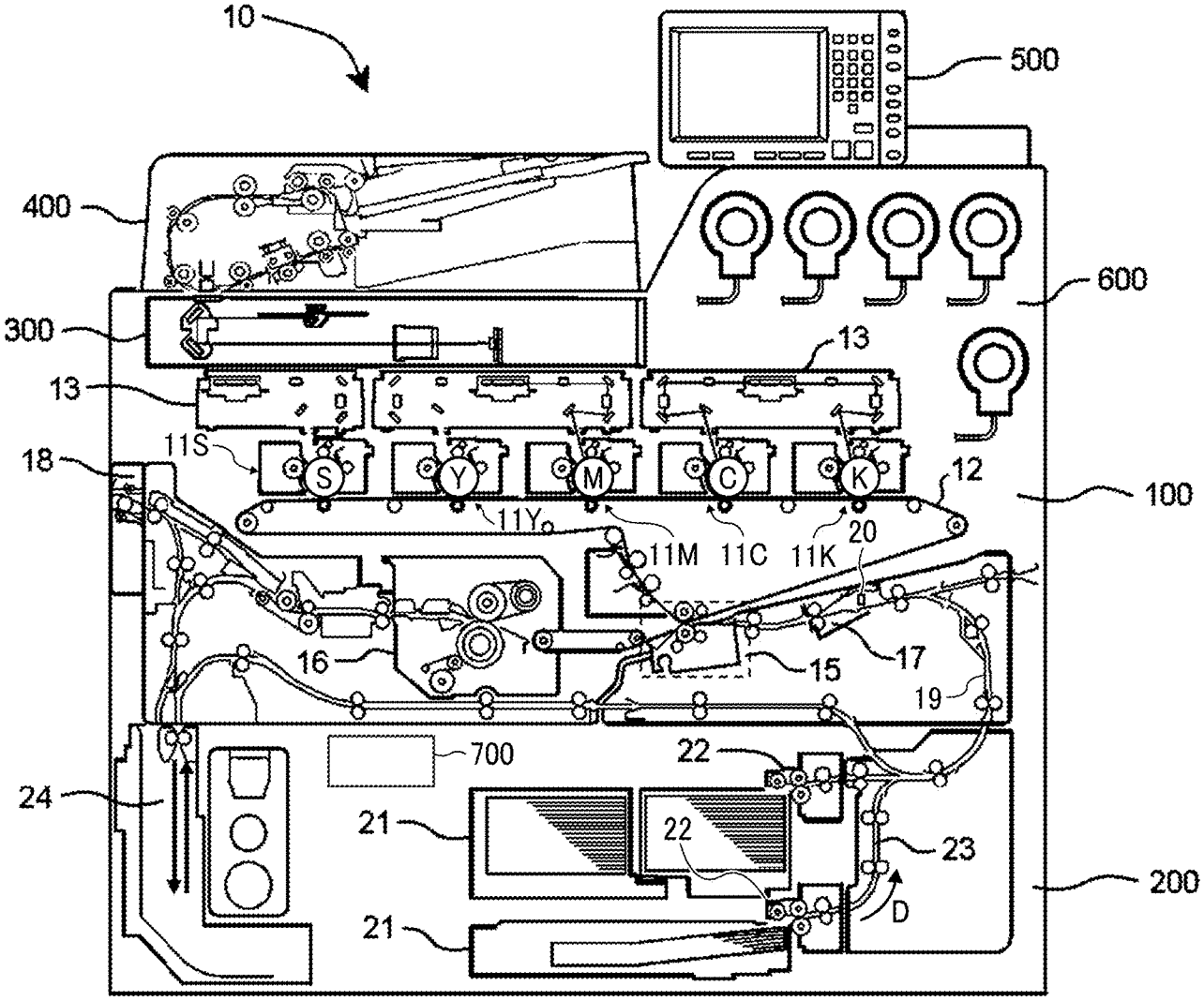
FIG. 1 is a schematic view illustrating a configuration of a printing apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

Descriptions are provided of embodiments according to the present disclosure.

FIG. 1 is a schematic view illustrating a configuration of an electrophotographic color copier (hereinafter, simply referred to as "a copier") as an example of a printing apparatus according to the present disclosure. Note that, although the embodiments are described here by the electrophotographic printing apparatus, the printing apparatus according to the present disclosure is not limited to the electrophotographic method, and any other image forming method such as an ink jet method, a thermal transfer method, or the like can be adopted. Therefore, a recording agent used for printing is not limited to toner, but any recording agent such as a liquid, for example, ink, or a gelled recording agent can be used. In addition, the recording agent is not limited to powder, liquid, and gel, but a suitable form, such as a ribbon or a film, containing or coated with the recording agent can be adopted.

The copier 10 illustrated in FIG. 1 includes a printer 100, a sheet feeder 200 on which the printer 100 is mounted, and a scanner 300 secured on the printer 100. The copier 10 further includes an automatic document feeder (ADF) 400 mounted on the scanner 300.

In FIG. 1, the printer 100 includes five image forming units 11S, 11Y, 11M, 11C, and 11K to form special color (S), yellow (Y), magenta (M), cyan (C), and black (K) images. Suffixes S, Y, M, C, and K are assigned to reference numerals of components that are used to form the special color, yellow, magenta, cyan, and black toner images, respectively.

The special color (S) is an optional color, and the special color image forming unit 11S according to the present embodiment uses clear toner. However, by replacing the developer, the special color image forming unit 11S can use another color toner.

In addition to the image forming units 11S, 11Y, 11M, 11C, and 11K, the printer 100 further includes an optical writing unit 13, an intermediate transfer unit 12, a secondary transfer device 15, a fixing device 16, and a registration roller pair 17. In an upper portion of the printer 100, a developer supply device 600 is disposed to accommodate toners of the special color, yellow, cyan, magenta, and black.

The sheet feeder 200 disposed in a bottom portion of a body of the copier 10 includes multiple sheet feeding trays 21 to accommodate sheets (recording media). The sheet feeding roller 22 feeds the sheet from the sheet feeding tray 21 to the feeding path 23 in a feed direction D.

In the image forming units 11S, 11Y, 11M, 11C, and 11K, toner images are formed on photoconductor drums by known electrophotographic processes. The toner images are primarily transferred onto an intermediate transfer belt of the intermediate transfer unit 12 and secondarily transferred by a secondary transfer device 15 onto the sheet, which is fed by the registration roller pair 17, such that the sheet coincides with the toner image on the intermediate transfer belt. After secondary transfer, the sheet bearing the toner image is conveyed through a fixing device 16 to fix the toner image on the sheet. The sheet is ejected by an ejection roller 18 onto the sheet ejection portion.

When duplex printing is performed, after the toner image is fixed on one side of the sheet, the sheet is conveyed into the reversal section 24 as a duplex printing mechanism to flip a front side and a back side of the sheet and further conveyed through a conveyance path 19 to the secondary transfer device 15 again, and a toner image is transferred onto the back side of the sheet. Then, the sheet passes through the fixing device 16 and is ejected to the sheet ejection portion.

A controller 700 including a central processing unit (CPU) and the like is disposed in a housing of the copier 10 for controlling respective components in the copier 10. A control panel 500 including a liquid crystal display, various key buttons, and the like is disposed on the upper surface of the housing. An operator inputs a command by the key button into the control panel 500 to transmit the command to the controller 700, thereby selecting a single-sided print mode for forming an image on only one side of the sheet, a double-sided print mode for forming images on both sides of the sheet, or the like.

Figure 2:
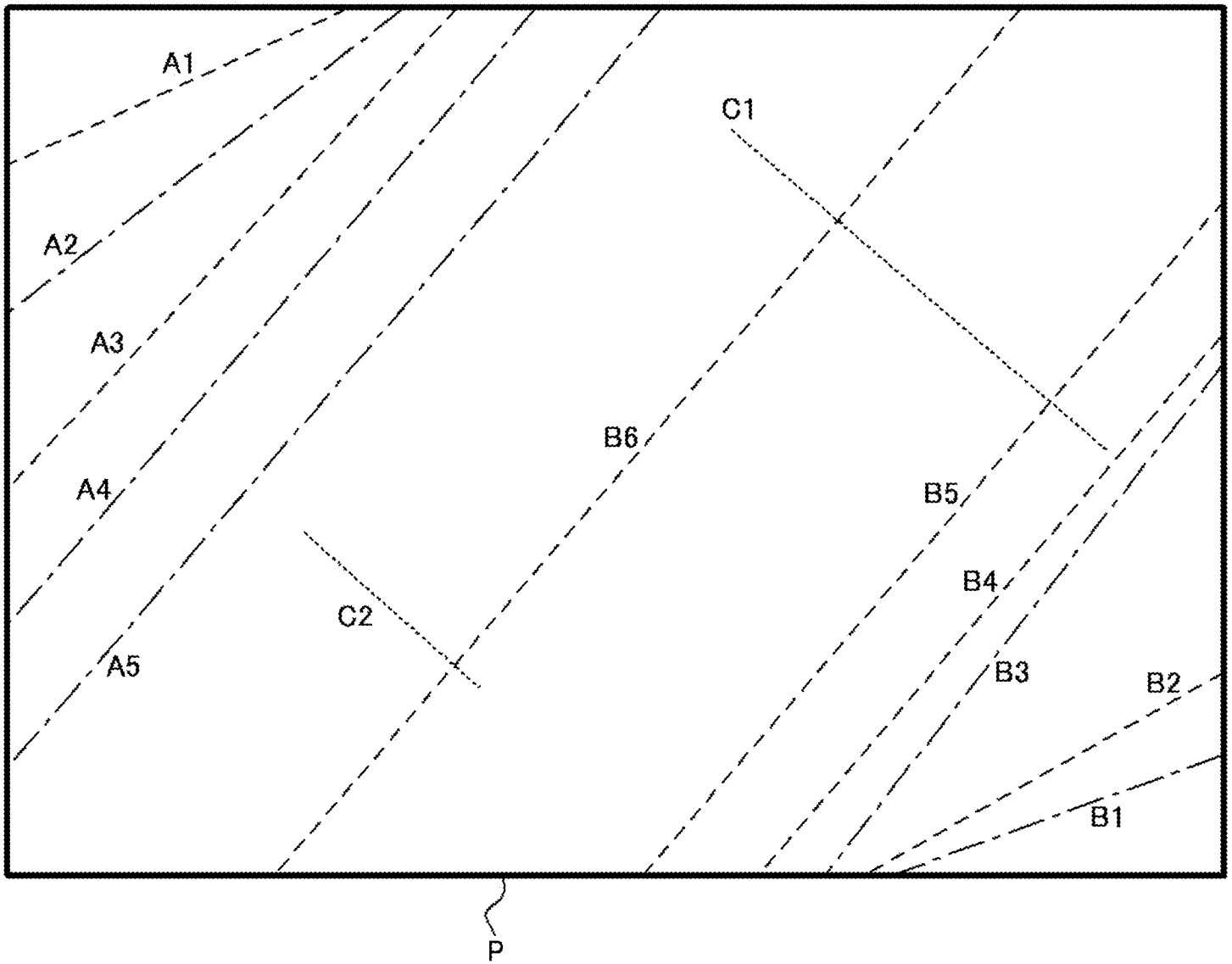
FIG. 2 is a development view of a recording medium on which a folding line is printed by the printing apparatus in FIG. 1.

FIG. 2 is a development view of a sheet-shaped recording medium such as a paper and a sheet (hereinafter, collectively referred to as "the sheet") on which a folding line (a folding guide line) is printed by the copier 10 in FIG. 1. Although folding a gift envelope for presenting a gift called "noshi-bukuro" in Japanese is described as an example, an object to be folded into a shape is not limited to the gift envelope, but an envelope, origami, wrapping paper, and the like can be other examples.

In FIG. 2, a broken line indicates the folding line for mountain fold and an alternate long and short dash line indicates the folding line for valley fold. The valley fold refers to a crease that becomes a valley shape when the sheet P is folded, and the mountain fold refers to a crease that becomes a mountain shape when the sheet P is folded.

The alternate long and short dash lines A2, A4, A5, etc. are printed on the back side of the sheet P. The broken lines B2, B4, B5, etc. are printed on the front side of the sheet P. Further, the broken lines C1 and C2 are printed on the front side of the sheet P.

In FIG. 2, for the sake of explanation of folding, the broken line and the alternate long and short dash line are used, but a solid line may be used for actual printing.

Figure 3:
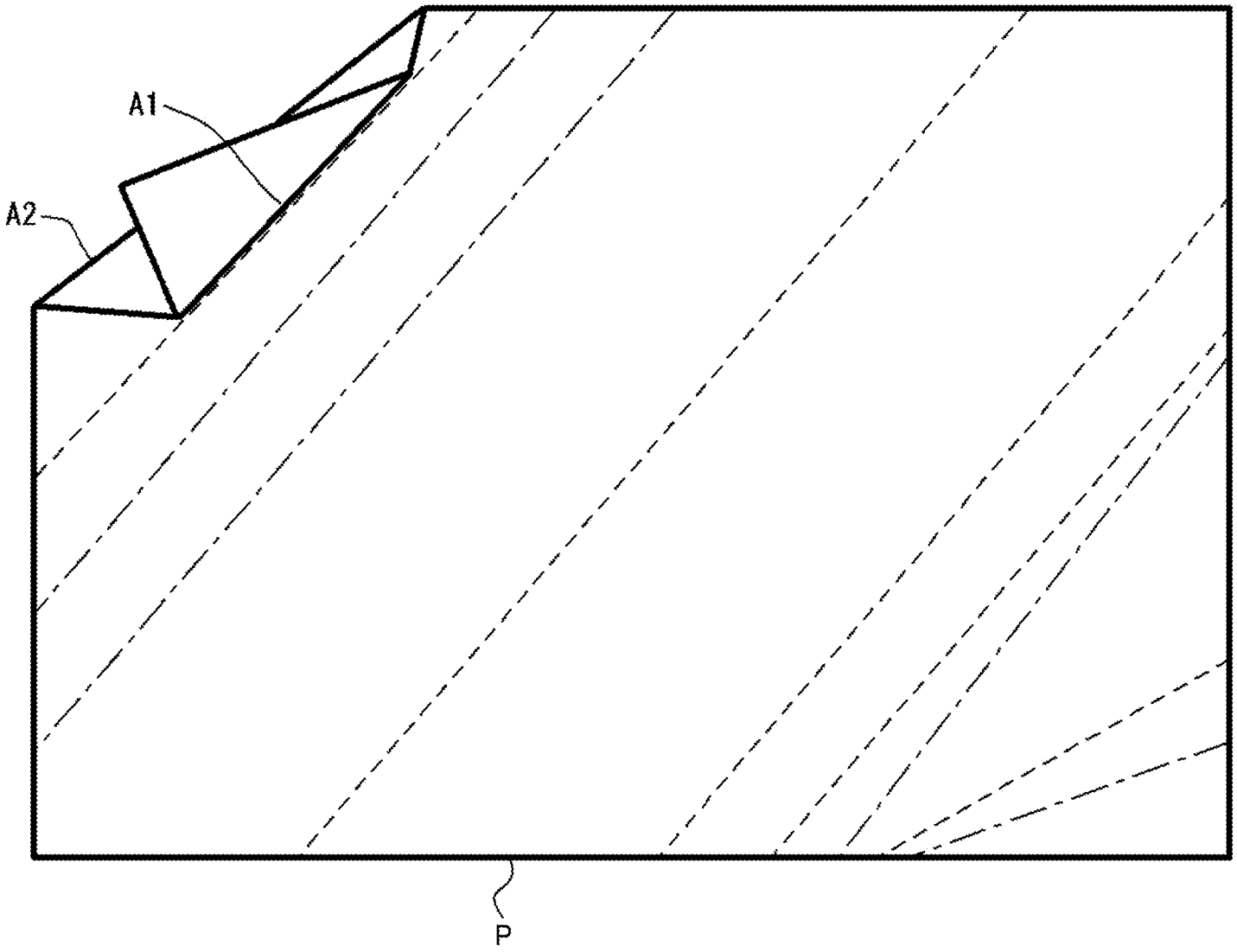
FIG. 3 is a plan view for illustrating a process (process 1) of folding the recording medium in FIG. 2 along the folding line.

FIG. 3 is a plan view for illustrating a process (process 1) of folding the recording medium, such as the sheet, in FIG. 2 along the folding line.

In FIG. 3, folding lines A1 and A2 are folded. The folding line A1 indicated by the broken line is printed on the front side of the sheet P and folded in the mountain fold. The folding line A2 indicated by the alternate long and short dash line is printed on the back side of the sheet P and folded in the valley fold. However, the folding line A2 is folded in the mountain fold as viewed from the back side of the sheet P.

When the sheet P is actually folded, it is difficult to fold a line that becomes the valley shape, such as the folding line A2, as a guide because the line is hidden by folding. Therefore, the valley fold lines such as the folding line A2 are more easily folded in the mountain fold by printing the lines on the back side of the sheet P.

Since the alternate long and short dash lines in FIG. 2 are printed on the back side of the sheet P, all the folding lines to be folded in the valley fold when viewed from the front side of the sheet P are printed on a side of the sheet P on which the folding lines are folded in the mountain fold as viewed from the back side of the sheet P.

When folding lines are printed on the valley side to make the folding line inconspicuous, it becomes hard to see the folding line when folding. Therefore, the folding lines are preferably printed on the mountain side (by printing as a mountain fold line) and the burden at the time of folding the sheet P is reduced.

However, folding lines in the mountain fold are visible on a surface of a finished product. Accordingly, there is a problem that the finished product looks bad. Measures to solve the problem are described later, and the description of the process of folding the sheet P is continued.

Figure 4:
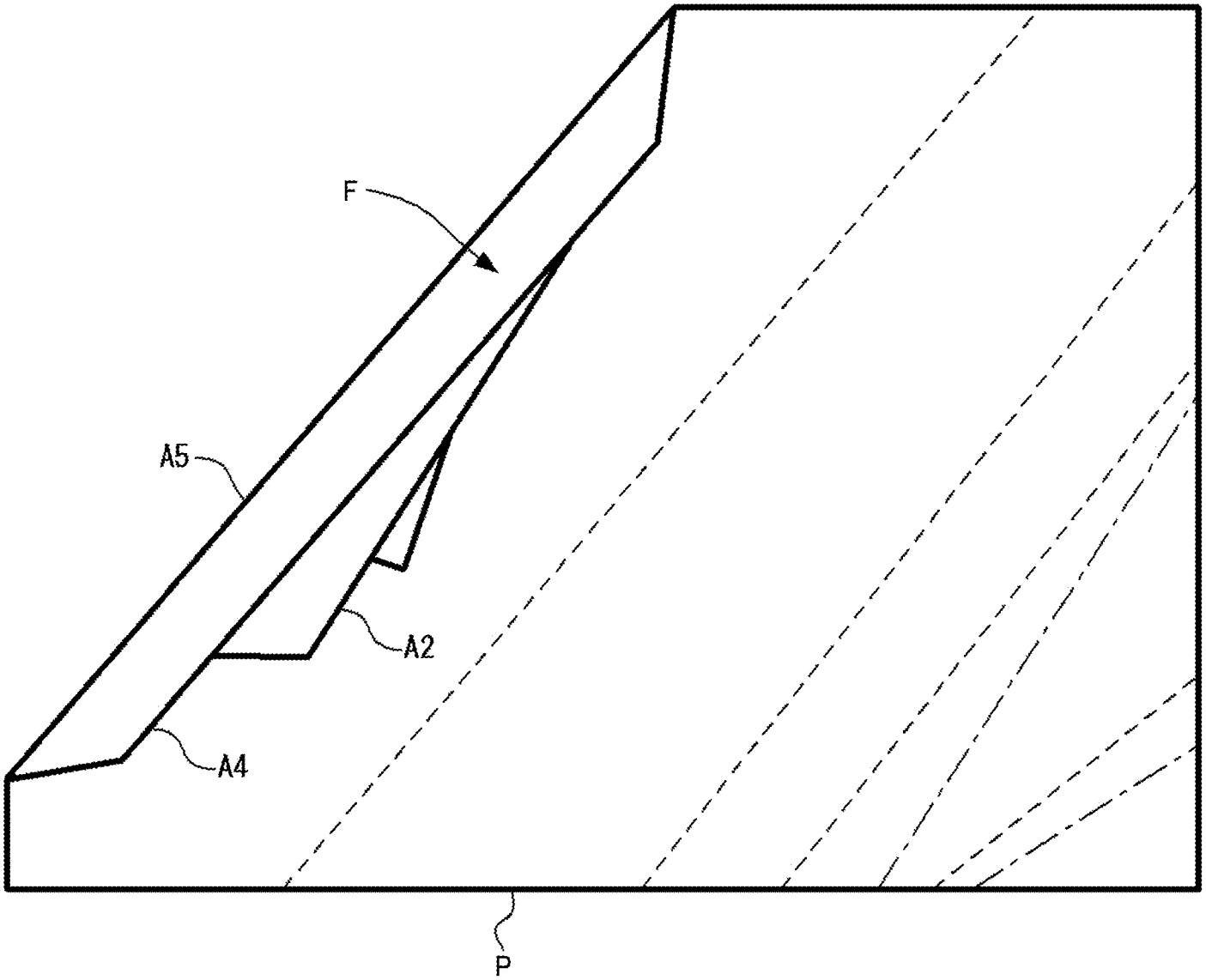
FIG. 4 is a plan view for illustrating another process (process 2) of folding the recording medium in FIG. 2 along the folding line.

FIG. 4 is a plan view for illustrating a process (process 2) of folding the sheet P in FIG. 2 along the folding line.

In FIG. 4, folding lines of a group A (A1 to A5) in FIG. 2 are folded. The folding lines of A2, A4, and A5 appear on the mountain side (the front side) of the sheet P as illustrated in FIG. 4. In other words, by folding the sheet P, the folding line of the sheet P goes around to the front side of the sheet P and becomes visible as viewed from the front side. When folding lines are printed on the valley side, folding the sheet P is difficult. Therefore, the folding lines of A2, A4, and A5 are printed on the mountain side (here on the back side of the paper P). However, the folding lines of A2, A4, and A5 are visually recognized when the folding lines of the group A is folded.

The gift envelope does not look good if the folding line is clearly recognized. Therefore, in the present embodiment, the folding lines A2, A4, and A5 are printed with the special color (clear, white, or the like) or a color close to the color of the sheet as a printing object. As a result, although the folding line can be recognized when printed on the sheet P and closely seen, the folding line is not visually recognized in the finished product (e.g., the gift envelope). Therefore, the design of the gift envelope is not impaired.

Since the folding lines A1 and A3 are hidden inside a portion F illustrated in FIG. 4, the folding lines A1 and A3 are not necessarily printed with the special color.

As described above, when the folding line is seen on the surface of the finished product, the appearance of the finished product becomes worse and the perfection as a printed matter decreases. In such a case, the folding line is printed with the special color toner such as the clear toner or the color toner close to the color of the sheet P (color with which the folding line is inconspicuous).

When actual printing is performed, a user can select the special color toner or an inconspicuous color by the control panel 500. Alternatively, a sensor 20 can be provided to detect the color, saturation, and lightness of the sheet P and the controller 700 automatically determines the optimum printing color to print. The sensor 20 is disposed near the conveyance path 19 upstream from the registration roller pair 17.

Note that, "color with which the folding line is inconspicuous" refers to the same color as the sheet P, colors adjacent to each other in the color circle, and the same colors with close saturation or lightness. "Same color" means that red, green, and blue (RGB) data is not only the same, but also includes a range of width. For example, the folding line is printed in black on a black sheet, thereby making the folding line inconspicuous. In addition to colors adjacent to each other in the color circle, a similar color includes an approximate color with close saturation or lightness.

In the present embodiment, the similar colors and approximate colors are collectively called "the similar color". The folding line is printed with a transparent recording agent, such as the clear toner, or in the similar color of the sheet P. As a result, the printing apparatus according to the present embodiment can print the development view of packaging goods with good appearance (such as bags, envelopes, gift envelopes, etc.) in which the folding line is inconspicuous.

Figure 5:
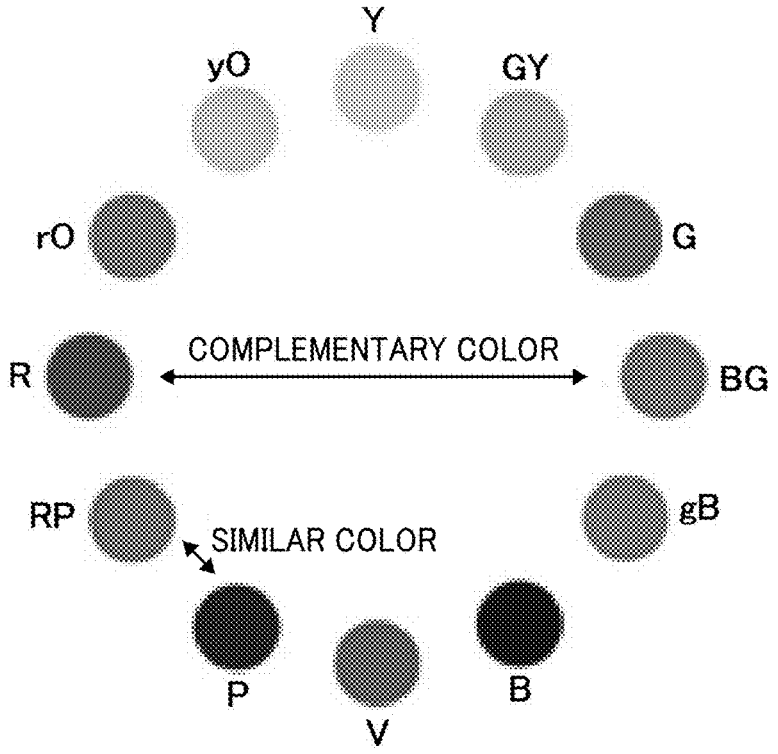
FIG. 5 is a schematic diagram of a color circle.

Next, description is provided of the three attributes of color. Three attributes of color include hue, lightness, and saturation. Hue arranged on a circle is called a color circle as illustrated in FIG. 5. Although hue is not expressed in color in FIG. 5 because of grayscale, the top of the color circle is yellow Y, the bottom of the color circle is violet V, the right side of the color circle is blue-green BG, and the left side of the color circle is red R. Colors that face each other across the center of the color circle (for example, green yellow GY and purple P, green G and red purple RP, green blue gB and red orange rO, and blue B and yellow orange yO) are complementary colors, and adjacent colors are similar colors.

Figure 6:
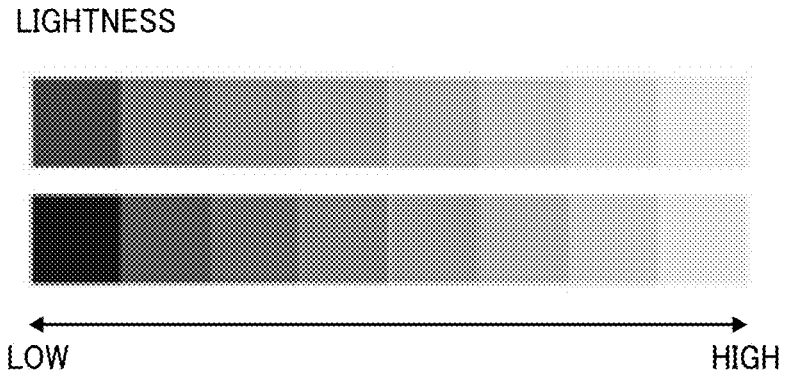
FIG. 6 is a schematic diagram of lightness.

The lightness is an element representing "brightness". Even if the hue and saturation are the same, the color with lower lightness becomes darker, the color with higher brightness becomes more white and brighter. FIG. 6 is a schematic diagram of lightness. Although color is not expressed in FIG. 6 because of grayscale, the lightness becomes higher to the right and lower to the left along the diagram.

Figure 7:
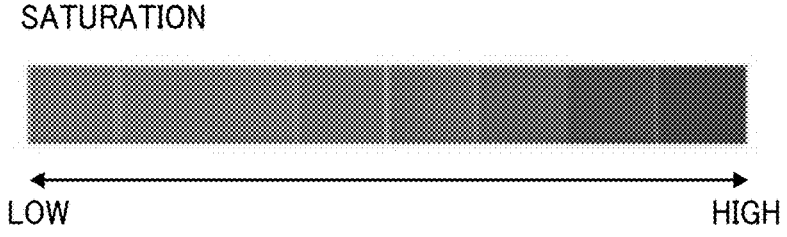
FIG. 7 is a schematic diagram of saturation.

The saturation refers to the vividness of color, and the color with the highest saturation in each hue is called a primary color or a pure color. When the saturation of a certain vivid color is gradually lowered, the color changes to a pale color and finally turns to achromatic color. FIG. 7 is a schematic diagram of saturation. Although color is not expressed in FIG. 7 because of grayscale, the saturation becomes higher (more vivid) to the right and lower to the left along the diagram. Even in the same color, the color with higher saturation looks more vivid, and the color with lower saturation is closer to gray. When the saturation is zero, there is no color, and the color becomes achromatic (black, white, or gray).

Figure 8:
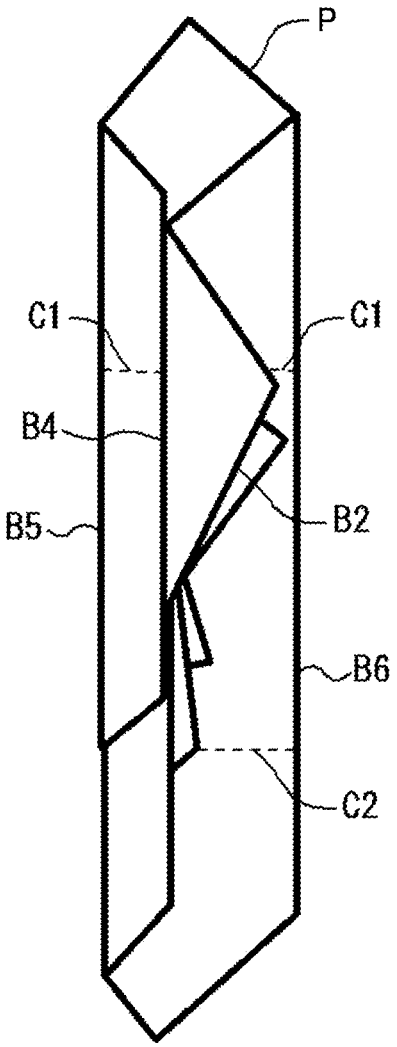
FIG. 8 is a plan view for illustrating yet another process (process 3) of folding the recording medium in FIG. 2 along the folding line.

FIG. 8 is a plan view for illustrating a process (process 3) of folding the sheet P in FIG. 2 along the folding line.

In FIG. 8, from the state in FIG. 4, the sheet is further folded according to the folding lines of group B (B1 to B6) in FIG. 1. Similarly to FIG. 4, since the folding lines B2, B4, B5, and B6 are visible when folded. Therefore, the folding lines B2, B4, B5, and B6 are preferably printed with the special color that is not recognized unless closely seen. Since the folding lines B1 and B3 are hidden inside, the folding line B1 and B3 are not necessarily printed with the special color.

Figure 9:
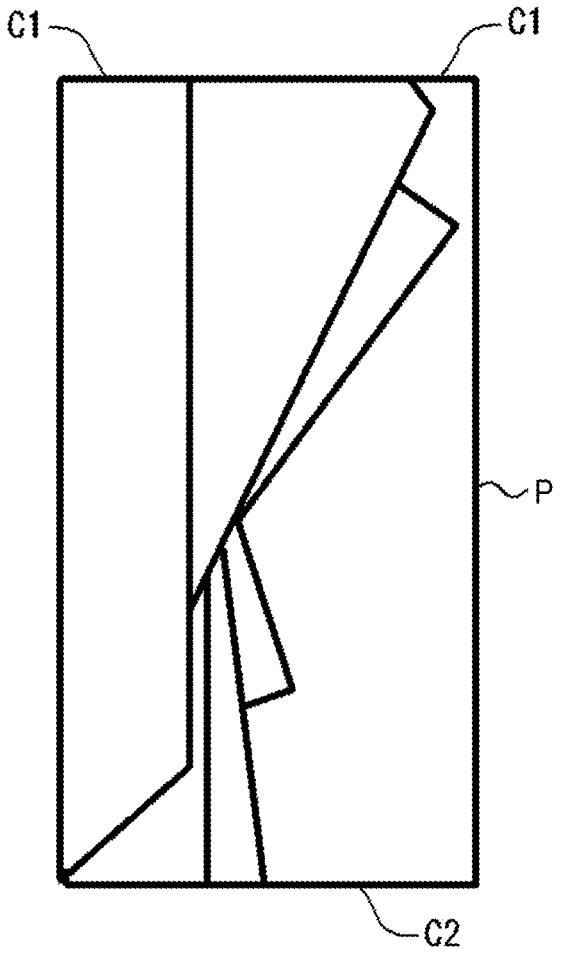
FIG. 9 is a schematic view for illustrating a state in which the recording medium in FIG. 2 is folded into a gift envelope for presenting a gift called "noshi-bukuro" in Japanese.

FIG. 9 is a schematic view for illustrating a state in which the sheet in FIG. 2 is folded into the gift envelope for presenting a gift called "noshi-bukuro" in Japanese.

In FIG. 9, from the state in FIG. 4, the sheet P is further folded along the folding lines C1 and C2 and folded up as the gift envelope (i.e., the finished product). Since the folding lines C1 and C2 are visible when folded, the folding lines C1 and C2 are preferably printed with the special color that is not recognized unless closely seen.

Figure 10A:
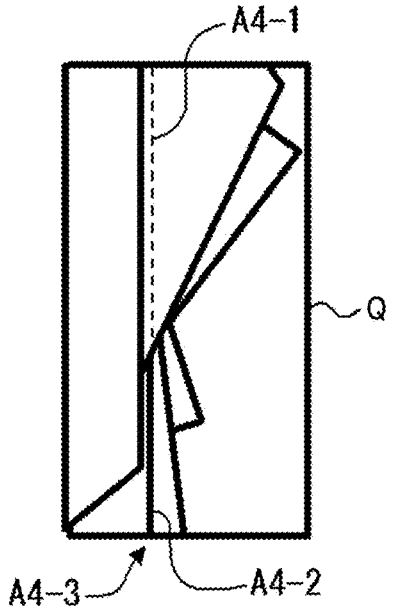
FIGS. 10A and 10B are schematic views of another example of a printed matter.
Figure 10B:
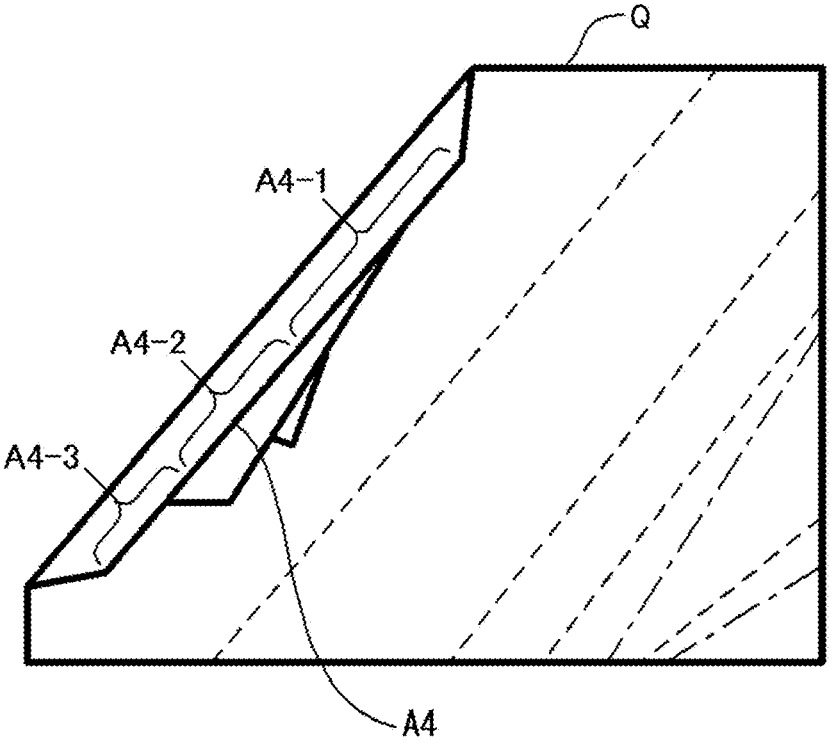

FIGS. 10A and 10B are schematic views of another example of a printed matter with a different folding line from the sheet P in FIG. 2. The sheet Q in FIGS. 10A and 10B is different from the sheet P in FIG. 2 in a manner in which the folding line A4 is printed.

FIG. 10A illustrates a completed state of the gift envelope, and FIG. 10B illustrates a state in which the folding lines of group A is folded. When comparing FIGS. 10A and 10B, the range A4-2 of the folding line A4 appears on the surface of the gift envelope, and the ranges A4-1 and A4-3 of the folding line A4 do not appear on the surface of the gift envelope.

Compared with the special color, the folding line printed in black is easier to fold. Therefore, the range of A4-1 and A4-3 can be printed in black. However, the range A4-2 that appears on the surface is preferably printed in the special color. In other folding lines, the folding line within the range that appears on the surface when folded up may be printed in the special color and the other range may be printed in black.

Even in the folding line which becomes a single crease in the development view, a portion of the folding line within the range hidden inside when folded is printed in a normal color (e.g., black), and a portion of the folding line within the range which appears on the surface of the gift envelope is printed in the special color or the color close to the color of the sheet Q. As a result, the amount of special color toner used can be reduced, and a maker can proceed to fold the sheet Q while having consciousness of the completed image.

Further, by performing printing with the special color or the color close to the color of the sheet as a printing object, the folding line can be visually seen regardless of elapsed time. Therefore, the maker can easily re-fold the sheet Q. A large-scale apparatus such as a decoloring apparatus is unnecessary, and the gift envelope with good appearance can be easily obtained.

Figure 11A:
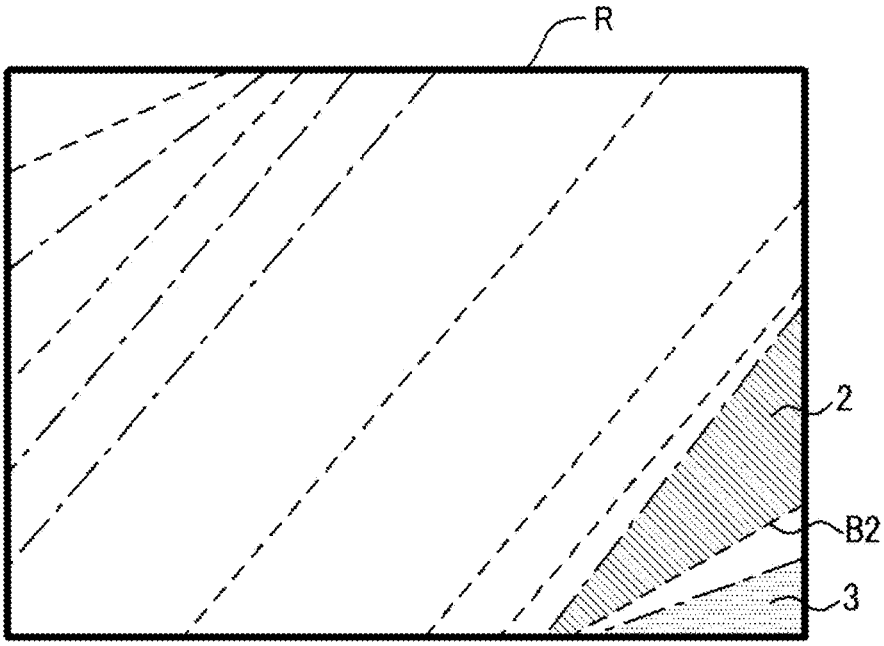
FIGS. 11A and 11B are schematic views of yet another example of a printed matter.
Figure 11B:
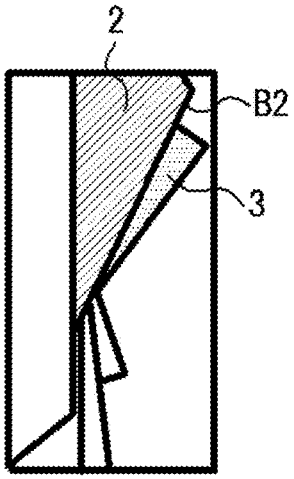

FIGS. 11A and 11B are schematic views of yet another example of a printed matter.

The printed matter R in FIG. 11A is an example in which a certain area between the folding lines is painted or a background pattern is printed in the certain area. FIG. 11A illustrates a development view, and FIG. 11B illustrates a completed state as a gift envelope.

As illustrated in FIG. 11A, a solid pattern 3 or a background pattern 2 is printed in the certain area (two areas in the example), so that the solid pattern 3 or the background pattern 2 in the certain areas appear on the design surface of the finished product (e.g., the gift envelope) as illustrated in FIG. 11B.

At that time, if the background pattern 2 is printed slightly beyond the folding line B2, even if the folding position is shifted with respect to the folding line B2, the boundary of the background pattern 2 does not appear on the surface.

Since the folding line B2 is the mountain fold line appearing on the surface, the folding line B2 is printed in the special color. Further, the folding line B2 is preferably printed in the special color after the background pattern 2 (or the solid pattern 3) is printed. Since the folding line B2 may be hardly seen when printed first, the folding line B2 is preferably printed after the background pattern 2 (or the solid pattern 3) is printed.

Figure 12A:
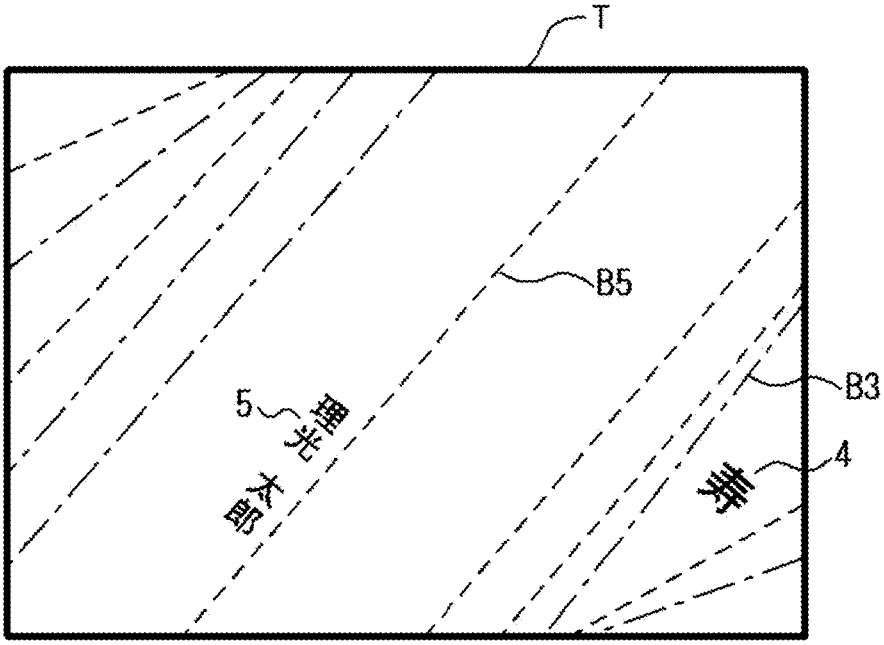
FIGS. 12A and 12B are schematic views of still yet another example of a printed matter.
Figure 12B:
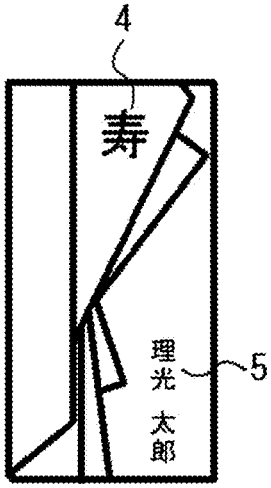

FIGS. 12A and 12B are schematic views of yet another example of a printed matter.

The printed matter T in FIG. 12A is an example in which characters are printed on the design surface. FIG. 12A illustrates a development view, and FIG. 12B illustrates a completed state as a gift envelope.

As illustrated in FIG. 12A, by printing a celebration character 4 and a signature 5 in a signature column, the celebration character 4 and the signature 5 appear on the design surface of the gift envelope in the folded state illustrated in FIG. 12B.

Since the celebration character 4 is printed at an angle parallel to a folding line B3 and the signature 5 is printed at an angle parallel to a folding line B6, the celebration character 4 and the signature 5 are correctly inclined (i.e., parallel to the longitudinal direction of the finished product) when the printed matter T is folded as illustrated in FIG. 12B.

Figure 13A:
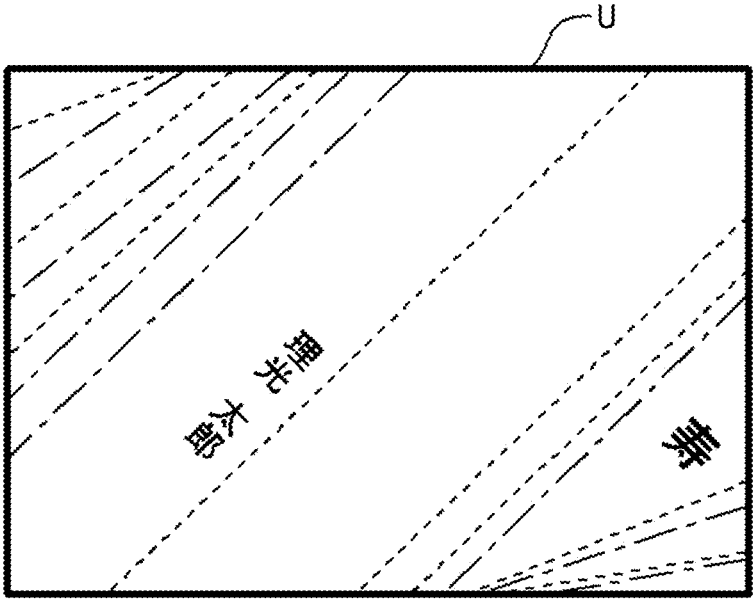
FIGS. 13A and 13B are schematic views of still further yet another example of a printed matter.
Figure 13B:
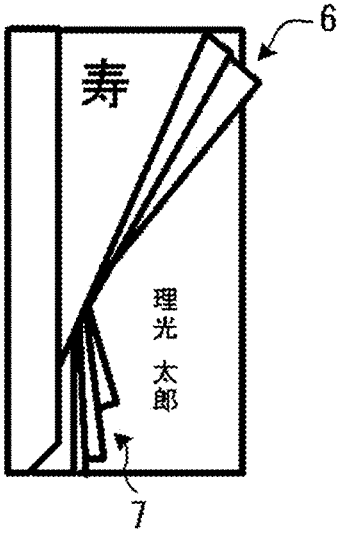

FIGS. 13A and 13B are schematic views of yet another example of a printed matter.

The printed matter U in FIG. 13A is the example in which folding lines different from the folding lines of the printed matter P in FIG. 2 and the printed matter T in FIG. 12A are printed, and the way of folding is different. FIG. 13A illustrates a development view, and FIG. 13B illustrates a completed state as a gift envelope.

As illustrated in the schematic view of the finished product in FIG. 13B, the number of peak portions 6 and 7 are different as compared with the gift envelopes into which the printed matter P in FIG. 2 and the printed matter T in FIG. 12A are folded. That is, the number of peak portions in FIG. 13B is greater than the number of peak portions of the above-described gift envelopes. Alternatively, the number of the peak portions may be decreased.

As described above, the folding line may be printed in the special color, the background pattern and the character may be printed, and/or the number of peak portions may be increased/decreased, as necessary. Therefore, the design as the gift envelope is enhanced, and the perfection as the printed matter is improved.

Above-described embodiments of the printed matter are described as, but not limited to, the gift envelope. The printing apparatus according to the present disclosure prints, for example, an envelope, an origami, a wrapping paper, or the like, thereby achieving ease of folding, high designability, and perfection of the finished product in folded state.

As described above, a printing apparatus, such as the copier 10 including a printer 100, according to the embodiments of the present disclosure prints a folding guide line, such as the folding line with the transparent recording agent, such as the clear toner, or with the recording agent having the similar color close to the color of the sheet in consideration of the color of the sheet. Therefore, the printing apparatus can print a development view for creating the packaging goods (such as bags, envelopes, gift envelopes, etc.) with no noticeable folding line and with good appearance.

The printer 100 of the printing apparatus prints at least a portion of the folding guide line that appears on the surface of the finished product after folding the sheet, with the transparent recording agent or the recording agent having the similar color close to the color of the sheet. Therefore, the folding line maintains ease of folding and allows makers to create the packaging goods with good appearance.

The printer 100 of the printing apparatus prints the solid pattern or the background pattern in the certain area that appears on the surface of the folded sheet. Therefore, the sheet on which the solid pattern or the background pattern is printed allows makers to easily create the packaging goods with excellent design.

The printer 100 of the printing apparatus prints the folding guide line after printing the solid pattern or the background pattern. Therefore, the folding guide line maintains visibility and ease of folding the sheet.

The printer 100 of the printing apparatus prints the character at an angle parallel to a certain folding guide line. Therefore, the printing apparatus can appropriately print the celebration character, the signature, and the like and allow makers to easily create the packaging goods with high quality.

The printing apparatus further includes a detector such as the sensor 20 to detect a color of the sheet. The controller 700 determines a color for printing the folding line according to the color detected by the detector, and the printer 100 automatically prints the folding guide line in the color according to the color determined by the controller 700. Therefore, the folding guide line is inconspicuous. The detector such as the sensor 20 is disposed, for example, near the conveyance path 19 upstream from the registration roller pair 17.

The printing apparatus further includes a duplex printing mechanism, such as the reversal section 24, to print on both of the front side and the back side of the sheet. The printer 100 of the printing apparatus prints the folding guide line that becomes the valley fold as viewed from the front side of the sheet, on the back side of the sheet. Therefore, makers can fold the sheet in the mountain fold according to the folding guide line on the back side as viewed from the back side of the sheet, and workability of creating the packaging goods is improved.

In a printed matter having a sheet shape according to the present disclosure includes a development view in which the folding guide line is inconspicuous and allows makers to create the packaging goods with good appearance (e.g., bags, envelopes, gift envelopes, and the like). The printed matter can be obtained at low cost.

The present disclosure is not limited to the exemplary embodiments described above. Any method can be adopted as the image forming method, and any recording agent can be used as the recording agent as long as the present disclosure can be performed. The form of the recording agent may be in any suitable form. The number of colors is also arbitrary. The printing apparatus is not limited to the copier 10. Alternatively, the printing apparatus may be a printer, a facsimile machine, or a multifunction peripheral having a plurality of capabilities.

In addition, the printed matter to be printed by the printing apparatus according to the present disclosure is not limited to the packaging goods such as bags, envelopes, gift envelopes, and the like, but may be any suitable printed matter such as origami and decorations.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Any one of the above-described operations may be performed in various other ways, for example, in an order different from the one described above.

What is claimed is:

1. A printing apparatus comprising:

a sheet feeder to feed a sheet in a feed direction;

a printer disposed downward from the sheet feeder in the feed direction to print a folding guide line on the sheet with a recording agent having a color based on a color of the sheet;

a detector to detect the color of the sheet; and a controller to determine a color to print the folding guide line, according to the color detected by the detector, wherein the printer prints the folding guide line in the color determined by the controller.

2. The printing apparatus according to claim 1, wherein the printer prints, with the recording agent having the color based on the color of the sheet, at least a portion of the folding guide line that appears on a surface of the sheet when the sheet is folded.

3. The printing apparatus according to claim 1, wherein the printer prints at least one of a solid pattern and a background pattern in an area that appears on a surface of the sheet when the sheet is folded.

4. The printing apparatus according to claim 3, wherein the printer prints the folding guide line after printing the solid pattern or the background pattern.

5. The printing apparatus according to claim 1, wherein the printer prints a character at an angle parallel to the folding guide line, in an area that appears on a surface of the sheet after the sheet is folded.

6. The printing apparatus according to claim 1, further comprising a duplex printing mechanism to print on both of a front side and a back side of the sheet, wherein the printer prints, with the duplex printing mechanism, the folding guide line for creating a valley fold as viewed from the front side of the sheet, on the back side of the sheet.

7. A printed matter comprising:

the folding guide line printed with the recording agent having the color based on the color of the sheet by the printing apparatus according to claim 1, wherein the printed matter has a sheet shape to be folded.

8. A printing apparatus comprising:

a sheet feeder to feed a sheet in a feed direction;

a printer disposed downward from the sheet feeder in the feed direction to print a folding guide line on the sheet with a recording agent having a same color as a color of the sheet, a detector to detect the color of the sheet; and a controller to determine a color to print the folding guide line, according to the color detected by the detector, wherein the printer prints the folding guide line in the color determined by the controller.

9. The printing apparatus according to claim 8, wherein the printer prints, with the recording agent having the same color as the color of the sheet, at least a portion of the folding guide line that appears on a surface of the sheet when the sheet is folded.

10. The printing apparatus according to claim 8, wherein the printer prints at least one of a solid pattern and a background pattern in an area that appears on a surface of the sheet when the sheet is folded.

11. The printing apparatus according to claim 10, wherein the printer prints the folding guide line after printing the solid pattern or the background pattern.

12. The printing apparatus according to claim 8, wherein the printer prints a character at an angle parallel to the folding guide line, in an area that appears on a surface of the sheet after the sheet is folded.

13. The printing apparatus according to claim 8, further comprising a duplex printing mechanism to print on both of a front side and a back side of the sheet, wherein the printer prints, with the duplex printing mechanism, the folding guide line for creating a valley fold as viewed from the front side of the sheet, on the back side of the sheet.

* * * * *